United States Patent [19]

West et al.

[11] Patent Number: 4,550,762

[45] Date of Patent: Nov. 5, 1985

[54] DIE CASTING PROCESS USING DISPOSABLE INSERTS DURING WARM UP

[75] Inventors: James C. West, Libertyville; Elmer G. Gesell, Waukegan, both of Ill.

[73] Assignee: Outboard Marine Corporation, Waukegan, Ill.

[21] Appl. No.: 544,011

[22] Filed: Oct. 21, 1983

[51] Int. Cl.[4] ..... B22D 19/00; B22D 17/20

[52] U.S. Cl. ..... 164/98; 164/113; 164/121; 164/312

[58] Field of Search ..... 164/98, 113, 119, 120, 164/121, 338.1, 47, 55.1, 332, 303, 312

[56] References Cited

FOREIGN PATENT DOCUMENTS 2402893 8/1974 Fed. Rep. of Germany ..... 164/122

53-42528 11/1978 Japan ..... 164/98

*Primary Examiner*—Nicholas P. Godici
*Assistant Examiner*—Kenneth F. Berg
*Attorney, Agent, or Firm*—John T. Synnestvedt; Richard D. Weber

[57] ABSTRACT

An improved die casting process for the production of castings which include metallic inserts. The process comprises the use of inexpensie non-metallic inserts in place of the metallic insert during the initial warm-up casting shots, said substitute inserts preferably being made of cardboard. The process is particularly well suited for the casting of die cast engine blocks wherein cardboard sleeves are substituted for the cast iron cylinder sleeves during the die warm-up casting shots.

8 Claims, 6 Drawing Figures

DIE CASTING PROCESS USING DISPOSABLE INSERTS DURING WARM UP

BACKGROUND OF THE INVENTION

The present invention relates generally to die casting processes and relates more particularly to an improved die warm-up process for use in the production of castings which include metallic inserts.

It is common practice in the manufacture of die cast articles to employ separately fabricated parts that are cast in and become an integral part of the casting. Such parts are aptly termed "inserts" and are usually employed to provide properties not otherwise obtainable with the cast metal. Inserts may be used, for example, to provide additional strength, hardness, abrasion resistance or other property to a particular region of a casting. Although a variety of materials may be used for inserts, ferrous metal inserts are commonly employed where increased strength or hardness is required.

Inserts often represent a substantial portion of the cost of the finished casting, either because of their size, complexity, and/or the materials of which they are fabricated. Should a casting be scrapped, the die cast metal can be remelted and cast again. However, the inserts usually cannot be recovered and thus may represent a substantial economic loss. Furthermore, there is risk of contamination of the melting furnace by the inserts when it is charged with scrapped castings.

A number of scrapped castings are produced during the start-up of a die casting machine. Since the proper operating temperature of the dies is achieved and maintained in large part by the heat retained from preceding casting cycles, a number of preliminary die warm-up casting cycles are required before the die is at its correct casting temperature. Proper die filling and such important casting characteristics as dimensional accuracy, strength and surface finish are dependent on the correct die temperature.

The number of casting cycles required to warm up the die will vary somewhat depending upon the sizes of the die and casting, the amount of preheating available and the nature of the casting alloy among other factors. However, at least four or five casting cycles are usually required to bring the die to the correct temperature and the so-called warm-up castings produced during this procedure must be scrapped because of their poor quality.

In those castings utilizing inserts, the inserts employed in the warm-up castings normally cannot be recovered. Although in some instances the warm-up castings can be made without the use of the inserts, in most cases the inserts are required, for example to prevent the castings from seizing on the die insert support.

BRIEF SUMMARY OF THE INVENTION

The present invention provides an improved procedure for use during the warm-up casting cycles in the production of die castings containing metal inserts. According to the present invention, inserts of an inexpensive, nonmetallic material are substituted for the metal inserts during the warm-up casting period. These warm-up inserts are preferably made of cardboard although other inexpensive materials such as ceramic materials could also be employed. For inserts of large volume, and wherein the warm-up insert is of an inflammable material, the warm-up insert may be coated with a fire resistant fluid to minimize flame and smoke upon ejection of the casting.

In particular, the invention is adapted to the die casting of engine blocks wherein cylindrical inserts of cast iron are employed as the cylinder liners. The use of cylindrical cardboard warm-up sleeves in place of the cast iron sleeves during the warm-up casting shots saves the cost of the cast iron sleeves conventionally used in the warm-up castings and eliminates the risk of contamination of the melting furnace when charged with the scrapped warm-up castings.

It is accordingly a primary object of the present invention to provide an improved die warm-up process which eliminates the loss of expensive, nonrecoverable metal inserts conventionally used in the scrapped warm-up castings.

Another object of the invention is to provide a process as described which can be inexpensively implemented and which facilitates the recovery of the cast metal from the scrapped castings.

A further object of the invention is to minimize the contamination of the melting furnace when charged with the scrapped warm-up castings.

Additional objects and advantages of the invention will be readily apparent from the following detailed description of an embodiment thereof when considered together with the accompanying drawings.

DESCRIPTION OF THE PREFERRED EMBODIMENT

Figure 1:
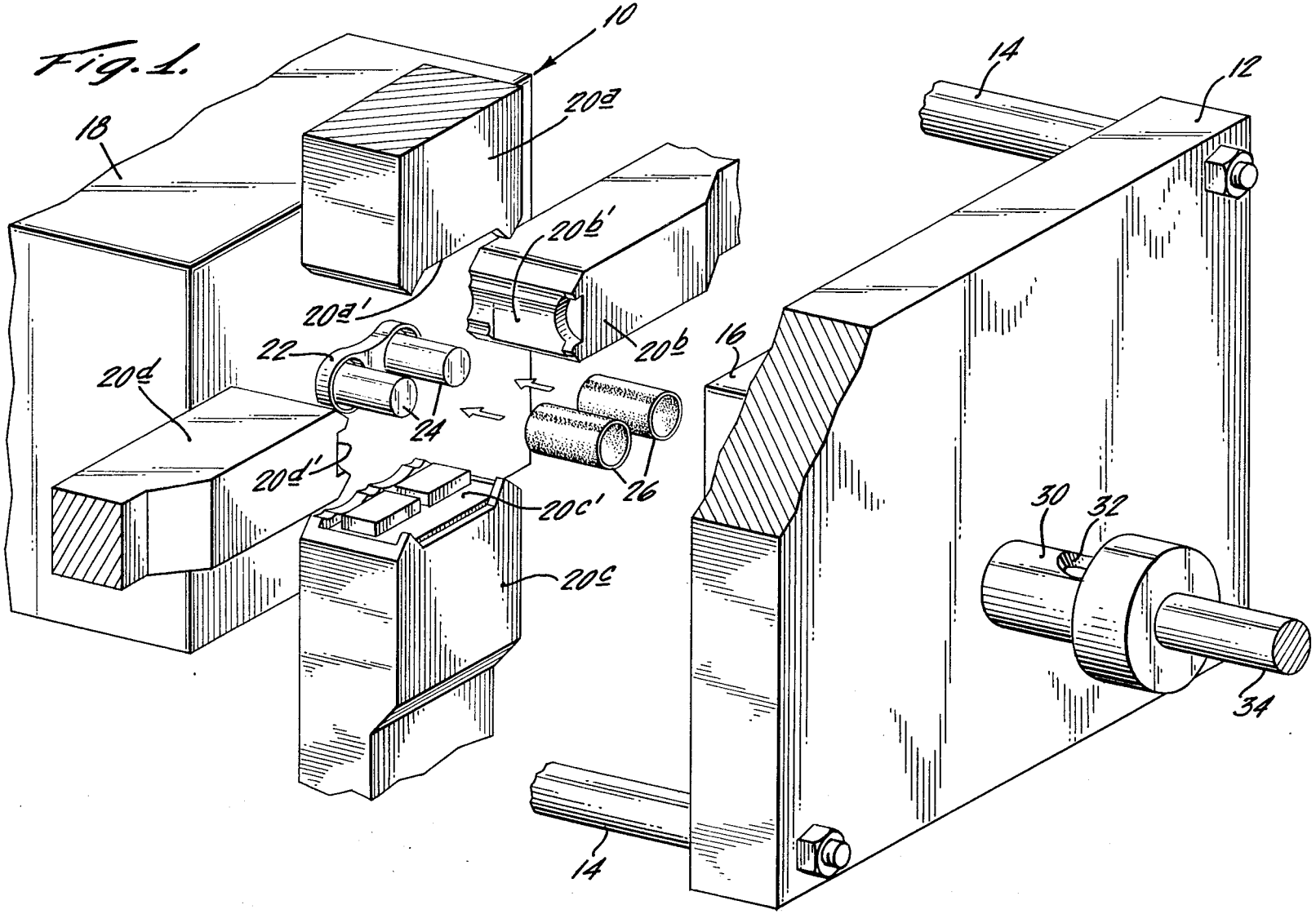
FIG. 1 is an isometric view partly broken away and in section showing a portion of a die casting machine with the die halves in the open position and with the warm-up sleeves in accordance with the present invention in position for insertion on the die core mandrels.

Although the process of the present invention can be utilized for the die casting of many types of articles incorporating metallic inserts, the process was developed for the die casting of aluminum alloy internal combustion engine blocks employing integral cast iron sleeve inserts as cylinder liners. The embodiment of the invention disclosed herebelow is accordingly directed to the die casting of engine blocks.

Referring to the drawings and particularly FIGS. 1–5 thereof, a portion of a conventional die casting machine generally designated 10 is schematically illustrated which comprises a front plate 12 mounted on the machine frame and a sliding plate (not shown) selectively moveable toward and away from the front plate on bars 14. A cover die 16 is secured to the inner side of the front plate 12 and is cooperatively aligned with an ejector die 18 mounted on the sliding plate. The cover die and ejector die comprise the die halves which, upon die closure, define the die cavity into which molten metal is injected under pressure.

The ejector die includes four sliding cores 20*a*, 20*b*, 20*c* and 20*d*. Means (not shown) are provided for sliding the cores 20*a–d* inwardly and outwardly during the casting cycle as described below. The sliding cores include inwardly directed impression faces 20*a'*, 20*b'*, 20*c'* and 20*d'* which cooperate in the closed position of the die halves to define the side walls of the die cavity.

A stationary core 22 on the ejector die inner face includes a pair of parallel cylindrical core mandrels 24, 24 which serve to define the bores of the engine block cylinders. Inserts in the form of cast iron sleeves are cast into the engine block as cylinder liners to provide a durable wearing surface for the engine pistons. The cast iron sleeves are supported within the die cavity by the mandrels 24, the mandrels serving both to accurately align the inserts within the casting as well as to prevent the molten metal from reaching the interior surfaces of the inserts. To carry out these functions, the mandrels 24 must be shaped and sized to closely fit the internal bores of the inserts. Since the insert bores are cylindrical, the mandrels have little or no draft. It would thus in this instance not be possible to produce warm-up castings without using inserts since the castings would upon solidifying, shrink onto the cylindrical bore core mandrels 24.

In accordance with the present invention, inserts 26, of an inexpensive non-metallic material are substituted for the cast iron sleeves during the warm-up casting shots. The substitute inserts 26 are preferably made of an inexpensive material such as cardboard which is not only cheap, but is also light in weight thus simplifying handling, and furthermore is substantially oxidized during the casting process so that the scrapped castings require little cleaning before remelting.

Other inexpensive materials in addition to cardboard may also be used for the warm-up inserts such as ceramic materials. Although the ceramic materials would not tend to produce smoke or flame, they would be more difficult to remove from the castings prior to remelting.

The substitute inserts 26 should have substantially the same internal diameter as the cast iron inserts which they are replacing during the warm-up casting shots. The wall thickness need not be the same as the cast iron inserts but should be sufficiently thick to prevent complete burn through of the metal and contact thereof with the bore mandrels. A wall thickness of 0.090" has been found to be satisfactory.

Figure 2:
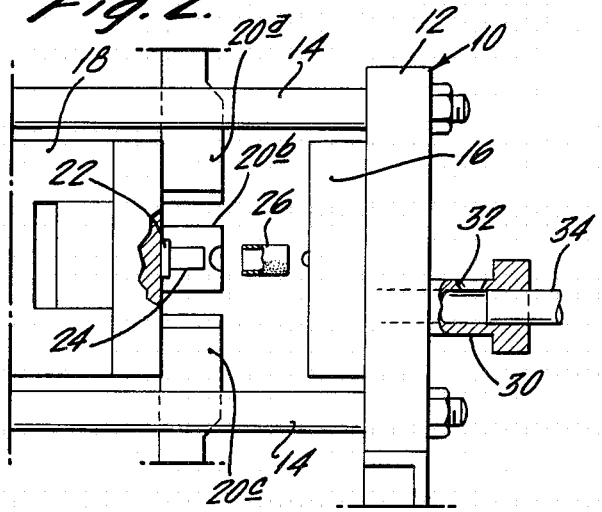
FIG. 2 is a reduced side elevational view of the portion of the machine shown in FIG. 1 with the die halves in the open position and the warm-up sleeves positioned adjacent the die core mandrels.
Figure 3:
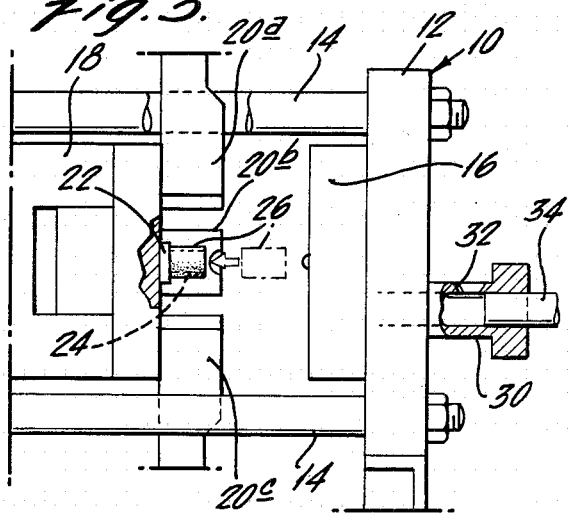
FIG. 3 is a view as in FIG. 2 but with the warm-up sleeves positioned on the mandrels.
Figure 4:
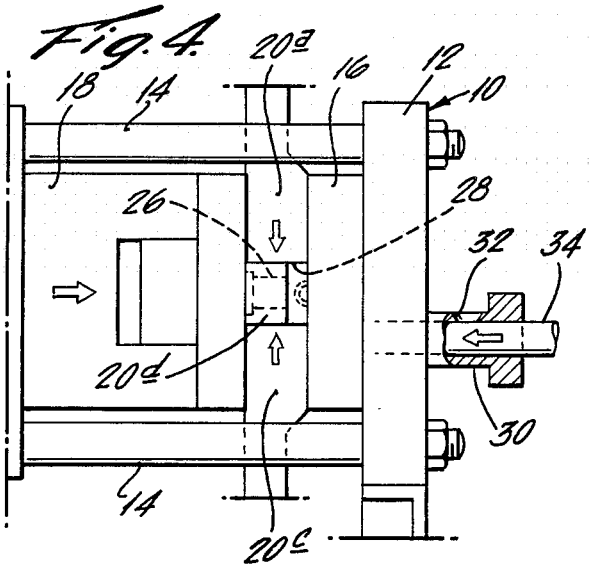
FIG. 4 is a view as in FIGS. 2 and 3 with the die halves closed and a warm-up casting cycle in progress.

For carrying out the process in accordance with the invention as is shown sequentially in the schematic views of FIGS. 2–5, the ejector die is moved to the open position with the sliding cores retracted. Following the spraying of the die halves with the usual die release agent, the warm-up sleeves 26, which are shown positioned adjacent the mandrels 24 in FIG. 2, are placed on the mandrels as shown in FIG. 3. The sliding cores are then advanced and the ejector die closed as shown in FIG. 4. In this position, the ejector die 18 with its sliding cores 20*a–d* forms in cooperation with the abutting cover die 16, a die cavity 28.

With the ejector die locked in the closed position, molten metal is introduced into the injection cylinder 30 through the pouring hole 32 and the plunger 34 is hydraulically advanced to rapidly move the molten metal under high pressure into the cavity 28 through suitable passages in the front plate and cover die.

Figure 5:
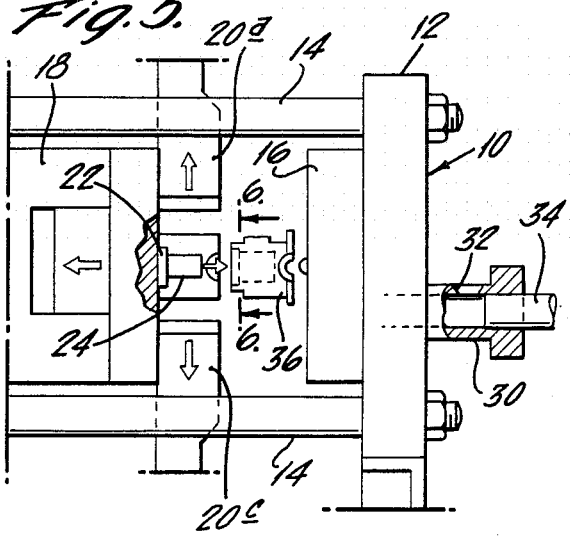
FIG. 5 is a view as in FIGS. 2–4 with the die halves open and the warm-up casting ejected.
Figure 6:
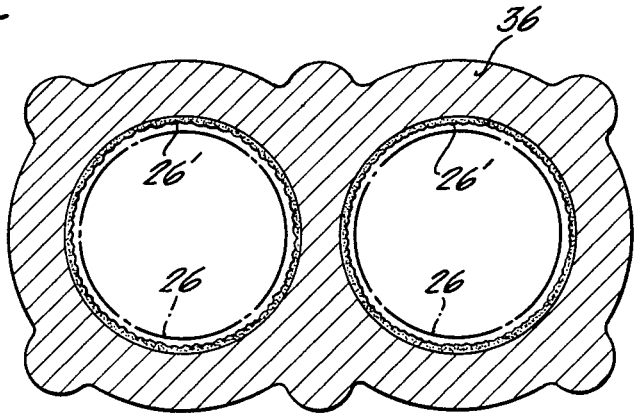
FIG. 6 is an enlarged sectional view taken along line 6—6 of FIG. 5 showing the warm-up casting with the warm-up sleeves partially burned away.

Upon opening of the ejector die as shown in FIG. 5, and the retraction of the sliding cores 20*a–d*, the warm-up casting 36 is ejected by ejector pins (not shown) and is then discarded. The discarded casting as shown in the enlarged view of FIG. 6 incorporates therein the partially oxidized warm-up sleeves 26 which now have an internal surface 26' of an enlarged diameter and of a somewhat charred condition. This condition results from the high temperatures of the molten metal and die which cause the flammable inserts to partially oxidize upon opening of the die and the ejection of the casting. Some smoke and flame are evident upon die opening but are normally not objectionable. Since disintegration of the warmup sleeve is advantageous and prepares the castings for remelting, it is preferable not to discourage the oxidation of the warm-up sleeves. If, however, the smoke and flame reach objectionable proportions, they can be minimized by the application of a suitable fire retardant coating to the surfaces of the warm-up insert and particularly the inner surface thereof. Sodium silicate or other fire resistant fluid could be used for this purpose.

Upon the completion of the series of warm-up castings, which normally comprises four or five casting cycles, the production casting run is commenced utilizing the cast iron inserts. The scrapped warm-up castings, after being cleaned of foreign matter, are remelted. The remains of the cardboard warm-up sleeves can readily be removed from the castings prior to remelting, for example, by flame treatment or mechanical means.

We claim:

1. In a die casting process comprising the sequential steps of:

opening a pair of opposed die halves;

positioning a metallic insert in one of said die halves;

closing said die halves to form a die cavity containing said insert;

injecting molten metal into said die cavity to form a casting incorporating said insert as an integral part thereof;

opening said die halves; and ejecting the casting from said die halves; and wherein a series of warm-up casting cycles are initially required to bring the die halves to the correct casting temperature;

the improvement comprising substituting a non-metallic insert of inexpensive material for said metallic insert during the warm-up casting cycles.

2. The invention as claimed in claim 1, wherein said non-metallic insert is formed of a combustible material.

3. The invention as claimed in claim 1, wherein said non-metallic insert is formed of cardboard.

4. The invention as claimed in claim 1, wherein said non-metallic insert comprises a ceramic material.

5. In a die casting process for the production of engine blocks having cast iron cylinder sleeves integrally cast therein, said process comprising the sequential steps of:

opening a pair of opposed die halves;

positioning a cast iron cylindrical sleeve insert in one of said die halves;

closing said die halves to form a die cavity containing said insert;

injecting molten metal into said die cavity to form a casting incorporating said insert as an integral part thereof;

opening said die halves; and ejecting the casting from said die halves; and wherein a series of warm-up casting cycles are initially required to bring the die halves to the correct casting temperature;

the improvement comprising substituting a tubular cylindrical cardboard insert for said cast iron insert during the warm-up casting cycles.

6. The invention as claimed in claim 5, wherein said one of said die halves includes a cylindrical core mandrel upon which said inserts are positioned.

7. The invention as claimed in claim 5, wherein said cardboard inserts are at least partly consumed by oxidation during the casting process.

8. The invention as claimed in claim 5, wherein each said casting incorporates a plurality of said inserts.

* * * * *